United States Patent [19]

Hofmann et al.

[11] 4,394,970

[45] Jul. 26, 1983

[54] FUEL INJECTION NOZZLE FOR COMBUSTION ENGINES

[75] Inventors: Karl Hofmann, Remseck; Kurt Seifert, Esslingen; Josef Jungbauer, Erding, all of Fed. Rep. of Germany

[73] Assignee: Robert Bosch GmbH, Stuttgart, Fed. Rep. of Germany

[21] Appl. No.: 232,338

[22] Filed: Feb. 6, 1981

[30] Foreign Application Priority Data

Feb. 7, 1980 [DE] Fed. Rep. of Germany ..... 3004454

[51] Int. Cl.[3] ..... B05B 1/32

[52] U.S. Cl. ..... 239/453; 239/533.7; 239/533.12

[58] Field of Search ..... 239/453, 533.3–533.12, 239/584

[56] References Cited

U.S. PATENT DOCUMENTS

| | | | |
|---|---|---|---|
| 2,439,832 | 4/1948 | Voit | 239/453 |
| 2,674,984 | 4/1954 | Bondi | 239/453 X |
| 2,820,673 | 1/1958 | Zubaty | 239/453 |
| 3,156,414 | 11/1964 | Dressler | 239/453 |
| 3,528,613 | 9/1970 | Berlyn | 239/453 |

FOREIGN PATENT DOCUMENTS

| | | | |
|---|---|---|---|
| 894789 | 10/1953 | Fed. Rep. of Germany | 239/533.12 |
| 491515 | 3/1954 | Italy | 239/533.7 |
| 906603 | 9/1962 | United Kingdom | 239/533.3 |

*Primary Examiner*—Johnny D. Cherry
*Attorney, Agent, or Firm*—Edwin E. Greigg

[57] ABSTRACT

A fuel injection pump provided with an outwardly opening valve needle, on the valve needle head of which there is disposed an injection cone, tapered in the direction of the fuel flow in extension of a cylindrical section of the needle head, for the purpose of shaping the injection jet.

7 Claims, 5 Drawing Figures

FUEL INJECTION NOZZLE FOR COMBUSTION ENGINES

BACKGROUND OF THE INVENTION

The invention is based on a fuel injection nozzle for combustion engines. In known fuel injection nozzles of this kind, the face of the needle head oriented toward the combustion chamber is formed flat to a large degree. Depending on the amount of injection, this may lead to vortexes of differing intensity which may cause considerable flow losses. In addition, a directed jet, more and more demanded by the producers of engines, is only possible with certain set injection amounts when using needle head configurations of this type.

OBJECT AND SUMMARY OF THE INVENTION

In contrast thereto, the fuel injection nozzle in accordance with the present invention has the advantage that, because of the avoidance of the formation of vortexes, no undesirable flow losses occur and that a desired jet direction is achieved thereby increasing the intensity of the jet. Another important advantage is that during the construction of the needle, especially of the sealing surfaces at the needle head thereof, the former can be clamped for working with the cone formed as a pin. This results in a high degree of accuracy, even when using simple clamping devices.

Fuel injection nozzles with needle heads wholly formed as truncated cones have already been proposed. However, a needle head of this type does not achieve the desired directed jet nor does it avoid vortexes, since vortexes are again generated by the remaining face at the end of the needle head and, furthermore, a truncated cone of this type can produce the desired form of a jet only with certain fixed injection amounts.

The invention will be better understood and further objects and advantages thereof will become more apparent from the ensuing detailed description of preferred embodiments taken in conjunction with the drawing.

DESCRIPTION OF THE PREFERRED EMBODIMENTS

Figure 1:
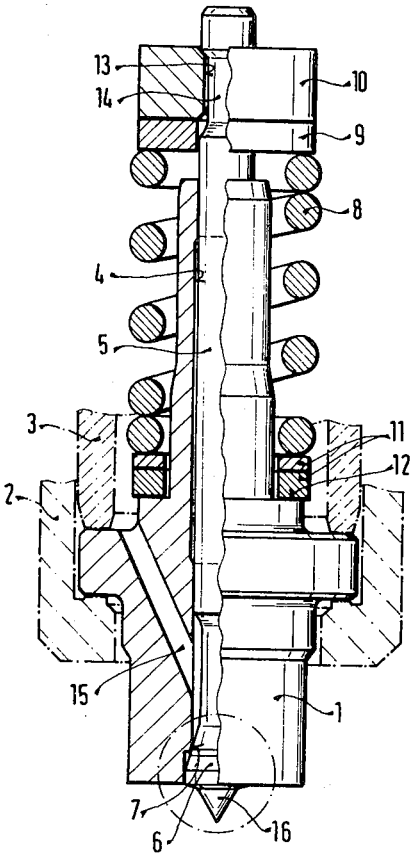
FIG. 1 generally is a cross-sectional view of a fuel injection nozzle with the needle valve shown encompassed in dotted lines.

FIG. 1 shows a partial view of a fuel injection nozzle, showing one part in elevation as an exterior view of the nozzle and the other part in cross section, in order to give a better overview of the relative proportions. A shaft-like nozzle body 1 is fastened to a nozzle holder 3 by means of a cap screw 2. Both cap screw 2 and nozzle holder 3 are only shown partially and by dotted lines. In a central bore 4 of a nozzle body 1 a valve needle which has a head 6 opening to the outside on the injection side is arranged to cooperate with a valve seat 7 disposed in the valve body 1. The needle head 6 is stressed on the valve seat 7 by a closing spring 8, which is braced, on the one hand, via a spring plate 9, by a snap ring 10 and, on the other hand, separated by washers 11, against a shoulder 12 of the nozzle body 1. The snap ring 10 has a keyhole-shaped aperture 13, in which is suspended the end of the valve needle 5 opposite of the injection side by means of an annular T-slot 14. As shown, as the fuel, which envelops the entire valve assembly, has reached a sufficiently high pressure, it displaces the valve needle 5 against the tension of the spring 8, so that the needle head 6 lifts from the valve seat 7 and fuel is supplied through a pressure line 15 and is injected, bypassing the valve seat 7. In order to avoid the formation of vortexes and to form the injection jet as described, a cone 16 is arranged to become an extension of a cylindrical section 17 which serves for the direction of the jet and is adapted to jut out into the combustion chamber. The base of section 17 with the end face of the head 6 is oriented toward the injection side.

In FIGS. 2 to 5 several different embodiments of this injection cone 16 are shown in an enlarged scale.

Figure 2:
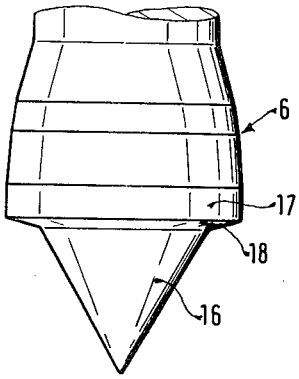

FIG. 2 shows the valve needle head 6 and the cone 16 of FIG. 1. The cone 16 changes over into the cylindrical section 17 of the valve needle head 6 via a steep inwardly directed conical section 18, where the base diameter of the cone 16 is smaller than the diameter of the cylindrical section 17.

Figure 3:
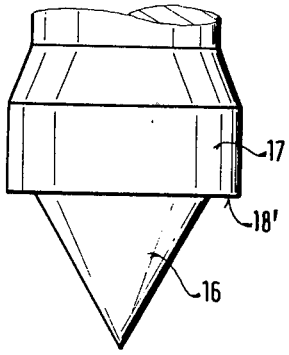
FIGS. 2, 3, 4 and 5 are horizontal elevational views of different embodiments of the needle valve shown encircled in FIG. 1.

In the variation according to FIG. 3, the shoulder towards cone 16 is formed at right angles to cylindrical section 17, thus forming a step surface 18'. Here, too, the base diameter of the cone is smaller than the diameter of the cylindrical section 17.

Figure 4:
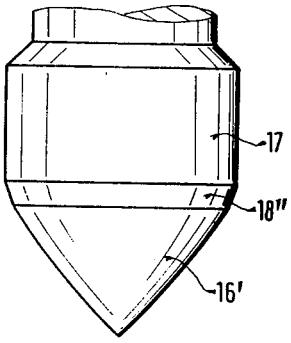

In the variation shown in FIG. 4, a different type of a cone section 18'' has been disposed between the cone 16' and the cylindrical section 17, but having a smaller enclosed angle. This angle is, at a minimum, small enough not to permit the imagined extension of the surface of the cone 16' to intersect the cylindrical surface 17, as has been the case with the previous variations.

Figure 5:
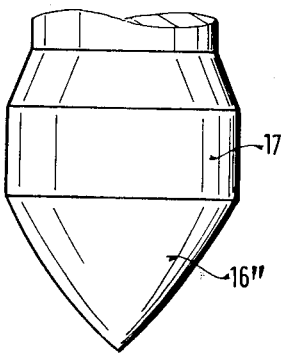

In the last variation, depicted in FIG. 5, the cone 16'' is a curved hyperbolic surface and immediately merges into the cylindrical section 17. Of course, other variations, such as a combination of spherical formation with a step, are possible.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection nozzle having an inlet end from which direction fuel flows and an injection end from which fuel is injected for combustion engines comprising a nozzle housing having a flat injection end surface, a bore in said nozzle housing, said bore including a small diameter section and an enlarged cylindrical end portion of uniform diameter which directly adjoins said small diameter section to form a valve seat through which a fuel jet is discharged, said enlarged cylindrical end portion extending from said valve seat to said flat injection end surface of said housing, a valve needle in said bore, said valve needle including a valve needle head portion, said valve needle head portion including a conical section with a cross sectional portion of greater diameter than said valve seat which conical section is arranged to close against said valve seat to close said bore and arranged to open in the direction of fuel flow, said valve needle head portion including a cylindrical portion of uniform diameter which adjoins said conical portion and extends downstream of said conical portion, said cylindrical head portion extends into said enlarged cylindrical end portion of said bore with a slight radial play when said valve needle is seated in a closed position against said valve seat, said valve needle head portion further includes a cone portion extending axially from said cylindrical portion with the vertex end of the cone in the direction of fuel injection to thereby shape the fuel jet emitted by said nozzle.

2. A fuel injection nozzle as defined in claim 1, characterized in that said cone portion has a base which is of a smaller diameter than said cylindrical portion of said needle head portion and that there is a transition zone between said cylindrical portion of said valve needle and said cone base.

3. A fuel injection nozzle as defined in claim 2, characterized in that said zone further includes a cone section.

4. A fuel injection nozzle as defined by claim 2, characterized in that said transition zone further includes a stap surface which extends horizontally toward the axis of said needle.

5. A fuel injection nozzle as defined in claim 1, characterized in that said cone portion has a surface which is a curved hyperbolic surface.

6. A fuel injection nozzle as defined in claim 1, characterized in that said cone portion includes an angle of 60°.

7. A fuel injection nozzle as defined in claim 1, characterized in that an imaginary extension of a surface line of said cone portion intersects the valve needle head portion.

* * * * *